US005148577A

United States Patent [19]

Silvey

[11] Patent Number: 5,148,577

[45] Date of Patent: Sep. 22, 1992

[54] FORMING TOOL FOR WIRE CLAMP

[76] Inventor: Elmer R. Silvey, 1231 Dutton Rd., Eagle Point, Oreg. 97524

[21] Appl. No.: 740,451

[22] Filed: Aug. 5, 1991

Related U.S. Application Data

[63] Continuation-in-part of Ser. No. 642,822, Jan. 18, 1991, abandoned, which is a continuation-in-part of Ser. No. 476,628, Feb. 8, 1990, abandoned.

[51] Int. Cl.[5] ..... B25B 27/10

[52] U.S. Cl. ..... 24/27; 81/9.3

[58] Field of Search ..... 24/27, 26, 28, 29, 20 R, 24/20 TT, 20 EE; 81/9.3, 9.4

[56] References Cited

U.S. PATENT DOCUMENTS

| | | | |
|---|---|---|---|
| 638,823 | 12/1899 | Vanderstel | 24/27 |
| 784,114 | 3/1905 | Moock | 81/9.3 |
| 899,657 | 9/1908 | Burtscher | 81/9.3 |
| 1,012,282 | 12/1911 | Schlangen | 81/9.3 |
| 1,027,097 | 5/1912 | Beam | 24/27 |
| 1,072,301 | 9/1913 | Blake | 81/9.3 |
| 1,078,533 | 11/1913 | Beaudette | 81/9.3 |
| 1,181,191 | 5/1916 | Whitlock | 81/9.3 |
| 1,347,579 | 7/1920 | Henrikson | 81/9.3 |
| 1,389,086 | 8/1921 | Yodges | 81/9.3 |
| 1,453,940 | 5/1923 | Lowrey | 81/9.3 |
| 1,507,170 | 9/1924 | Gunn | 24/27 |
| 1,553,110 | 9/1925 | Rich | 81/9.3 |
| 1,619,766 | 3/1927 | Riordan et al. | 24/27 |
| 1,783,123 | 11/1930 | Kiviaho | 81/9.3 |
| 2,362,112 | 11/1944 | Capra | 81/9.3 |
| 2,421,878 | 6/1947 | Gubser et al. | 81/9.3 |
| 2,562,055 | 7/1951 | Miller | 81/9.3 |
| 2,880,634 | 4/1959 | Betz | 81/9.3 |
| 4,084,625 | 4/1978 | Brinegar | 81/9.3 |

FOREIGN PATENT DOCUMENTS

| | | | |
|---|---|---|---|
| 153263 | 3/1932 | Switzerland | 24/27 |
| 694540 | 7/1953 | United Kingdom | 81/93 |

*Primary Examiner*—Victor N. Sakran

*Attorney, Agent, or Firm*—Eugene M. Eckelman

[57] ABSTRACT

A tool for forming a wire clamp using a piece of wire with a connecting loop at one end and at least one end leading from the loop. The tool has a body portion with a forward end arranged to engage the loop end of the wire for holding the loop end in a stationary position. The body portion includes a tension member for pulling the wire tightly around the article. In an embodiment of the tool, the nose end of the tool is pivotally attached to the body portion for reaching limited area spaces, and in another embodiment a wire slack take-up crank is provided on the tension member.

13 Claims, 3 Drawing Sheets

FIG. 9
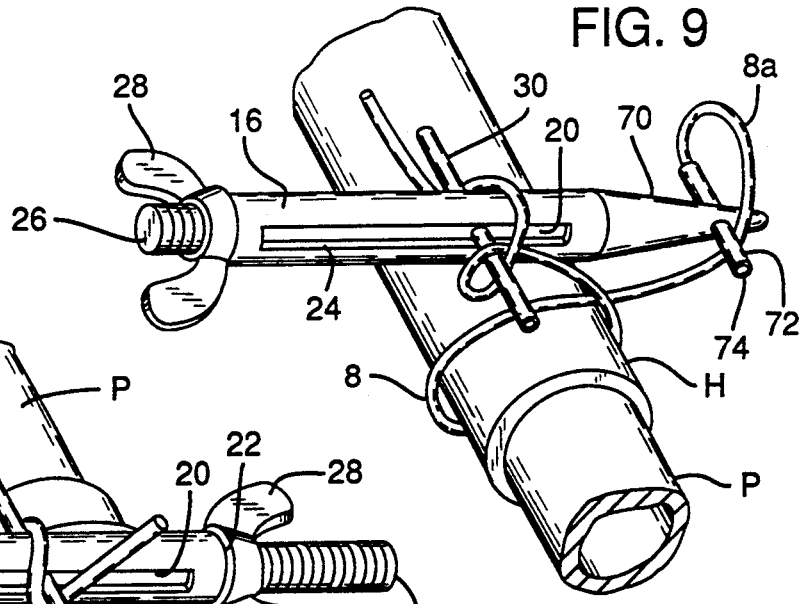
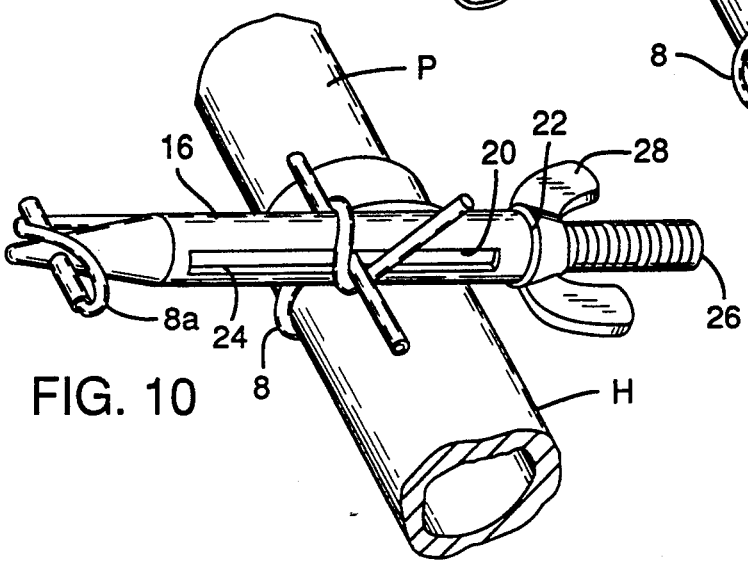
FIG. 10
FIG. 11
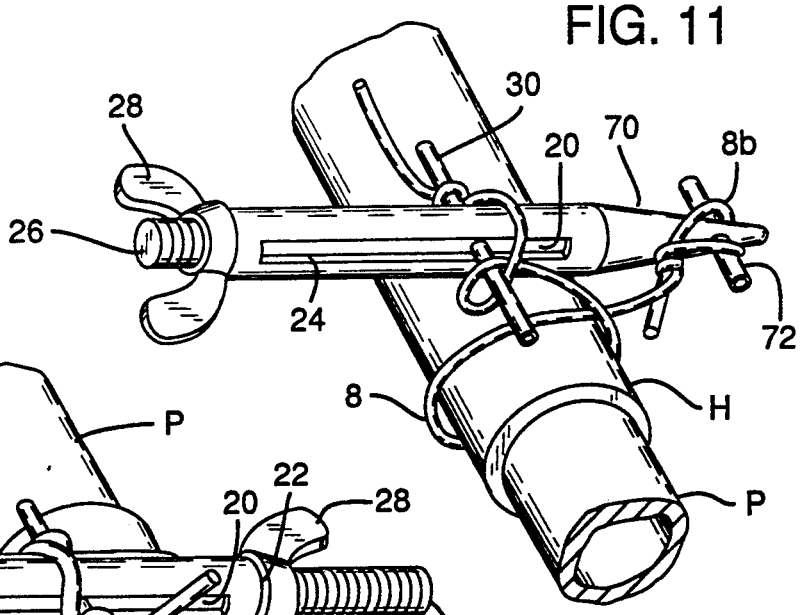
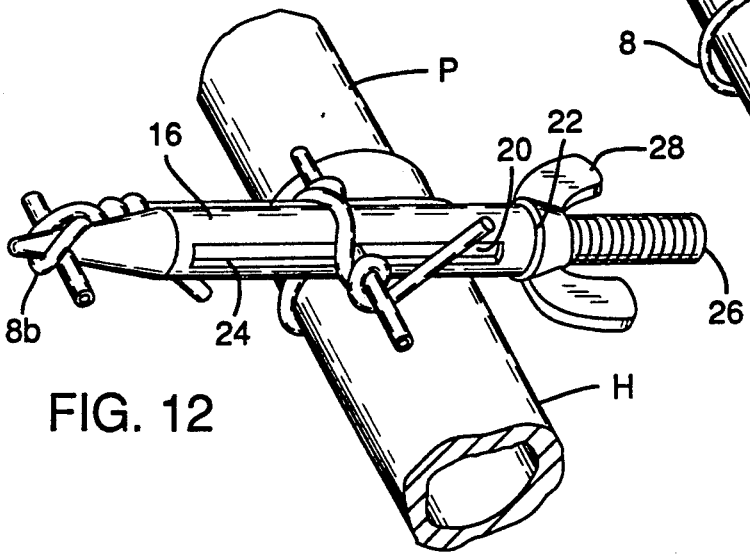
FIG. 12

FORMING TOOL FOR WIRE CLAMP

REFERENCE TO PRIOR APPLICATIONS

This application is a continuation-in-part of application Ser. No. 07/642,822, filed Jan. 18, 1991, in turn a continuation-in-part of application Ser. No. 07/476,628, filed Feb. 8, 1990, both now abandoned.

BACKGROUND OF THE INVENTION

This invention relates to new and useful improvements in a tool for forming wire clamps.

A popular clamp comprises a band arranged to encircle a hose or the like and apply pressure on the periphery of the hose for forcing it against a rigid interior pipe or the like. The applied pressure is accomplished by a tangential screw which is secured to one end of the band and which draws the other end past the clamp for cinching the band around the hose. Clamps have also been provided that use a conventional piece of wire to encircle an article for clamping the article on a support.

SUMMARY OF THE INVENTION

A primary object of the invention is to provide improvements in the type of tool that forms a clamp from a piece of conventional wire.

In carrying out these objectives, the invention is arranged to form a wire clamp from a piece of conventional wire of any type that is sufficiently flexible and of a tensile strength capable of being cinched tightly around an article to be clamped. Such a clamp comprises wire having a connecting loop at one end and a portion thereof leading from the loop. The wire is wrapped around the article to be clamped and is pulled tightly around the article with the loop being held in a stationary position, thus forming a peripheral clamping force on the article. The wire can be wrapped one or more times around the hose. The tool of the invention has a body portion with a nose end arranged to engage the loop in the wire for holding the loop in position. Means for pulling the wire tightly around the article include a longitudinally movable tension member and anchor means on this tension member for connecting it to the wire. The tension is applied by drive means on the tension member which force it longitudinally away from the clamp to tighten the wire around the article. The tool may include a pivoted nose section for ease of installation in tight places. The tool may also include slack take-up means on the tension member, as illustrated in a modified form.

The invention will be better understood and additional objects and advantages will become apparent from the following description taken in connection with the accompanying drawings.

BRIEF DESCRIPTION OF THE DRAWINGS

FIG. 9 is a perspective view of an embodiment of the invention that utilizes a single strand of wire as the clamp, this view showing an initial step in the formation of the wire clamp.

FIG. 10 is a perspective view taken similar to FIG. 11 but from the opposite end and also showing a further step in the formation of the wire clamp.

FIG. 11 is a perspective view of an embodiment also designed for forming a single strand of wire, this view showing an initial step in the formation of the clamp, and FIG. 12 is a perspective view taken from the opposite end of FIG. 11 and showing a further step in the process of forming a wire clamp.

DETAILED DESCRIPTION OF PREFERRED EMBODIMENTS

With reference to the drawings and first to FIGS. 1–4, a clamp formed by the tool of the invention comprises a piece of wire 8 which is doubled back to form a loop 10 and strands 12 leading from such loop and terminating in free ends 14. The strands are wrapped one or more times around an article to be clamped, such as a hose H, with the loop 10 held closely adjacent to the hose. The strands 12 after encircling the hose are passed through the loop 10, and as will be seen the free ends 14 upon being pulled tightly through the loop cause the wrapped strands 12 to tightly clamp the hose on a pipe P or other member. After the wire is pulled tightly around the hose and through the loop 10, it is bent over the top of the loop and pinched down, as by a pliers, to form locking tag ends 14*a*.

Figure 1:
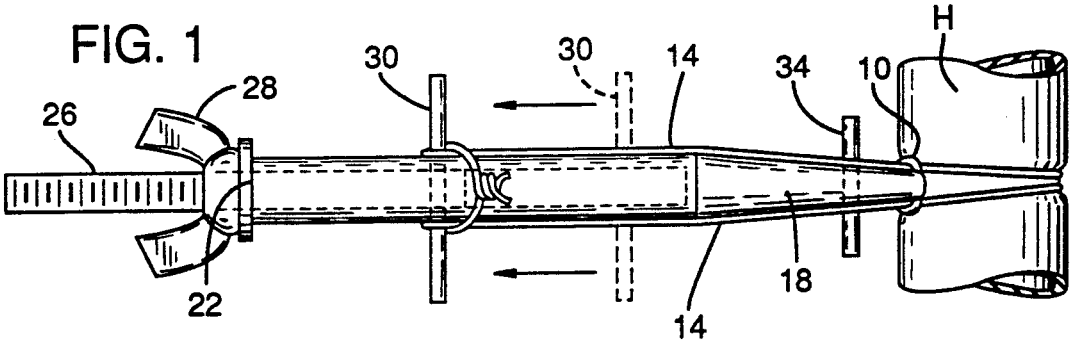
FIG. 1 is a plan view showing a first form of tool of the invention for forming a wire clamp of the type described.
Figure 2:
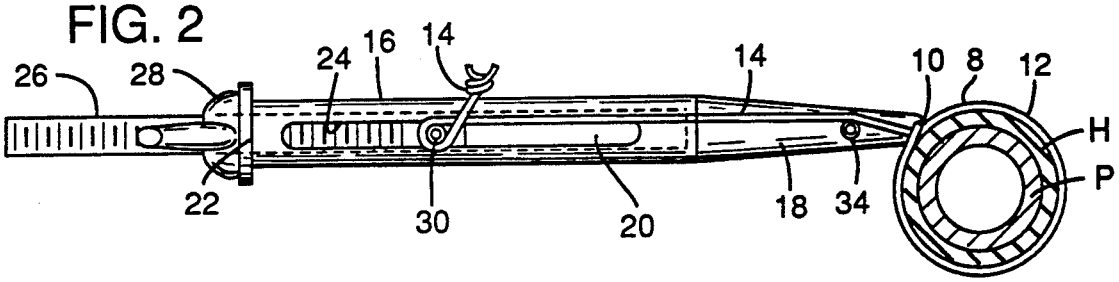
FIG. 2 is a side elevational view of the clamp tool of FIG 1.
Figure 3:
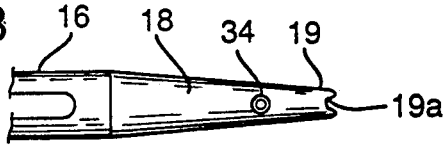
FIG. 3 is an enlarged side elevational view of a nose portion of the tool of FIG. 1.

FIGS. 1–3 show a first form of tool for forming the clamp. This tool comprises an elongated rigid body portion or member 16 having a forward end portion 18 tapered to a smaller nose end 19 which has cross recess 19*a*. The body portion 16 is tubular in construction, having a hollow interior 20 which opens through the rearward end 22 thereof. Each of the sides of the body portion 16 has an elongated slot 24 therein.

Freely slidable in the hollow body portion and projecting through the open rearward end is an elongated threaded tension member 26 having a wing nut 28 mounted on the projecting portion thereof. Backing off the wing nut 28 allows the tension member to be moved forwardly in the body portion and advancing it on the tension member causes it to abut against end 22 and drive the tension member rearwardly.

Tension member 26 has an integral cross pin 30 intermediate its front and rearward ends which projects through the slots 24 beyond the sides of the body portion 16. These projecting ends form anchor means for the wire. Forward end portion 18 has an integral cross guide pin or guide 34 projecting from both sides thereof and located a short distance rearwardly of the nose end.

In the formation of a wire hose clamp by the present tool, the tension member 26 is first moved to a forward position in the body portion 16, as shown by the cross pin 30 in broken lines in FIG. 1, by backing off the wing nut 28. The piece of wire 8 is then applied manually around the hose with the strands 12 encircling the hose one or more times and with the loop end 10 held in a fixed position at the hose and above the center thereof. The strands of the wire are passed through the loop and the tool is then applied by hooking the recessed nose onto the loop 10. The free ends 14 of the wire extend rearwardly over the pins 34 and are tied to respective sides of cross pin 30, or if desired, these free ends may be tied together across the tool after bending them over or under the pin 30, FIG. 2. The wing nut 28 is then rotated in a direction to draw the tension member 26 rearwardly whereby to pull the wire tight for cinching it around the hose. With the nose end 19 in the loop 10 and above center of the hose, such nose end is locked in place and will remain in such abutted position during tightening of the wire.

Figure 4:
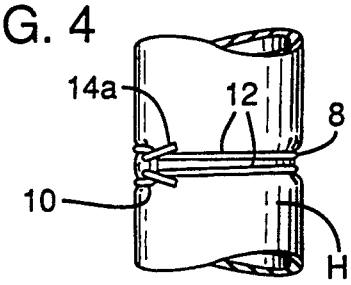
FIG. 4 is a plan view of a completed wire clamp formed by the invention.

With reference to FIG. 4, after the wire has been pulled tight the tool is pivoted up at its nose end to bend the wire strands 14 over the top of the loop 10. The wire strands are then cut off to form the tag ends 14. The tag ends are then pinched down.

Figure 5:
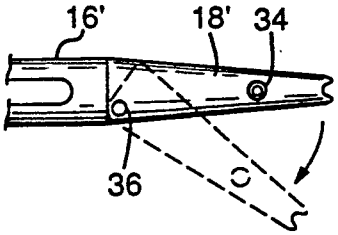
FIG. 5 is a view similar to FIG. 3 but showing an embodiment of the invention that utilizes a pivotal nose portion.

With reference to FIG. 5, the forward end portion 18' of the tool has a hinged connection 36 with body portion 16'. This allows the body portion to tilt relative to the nose end for manipulation in tight places wherein the tool cannot be rotated sufficiently to bend the tag ends 14*a* fully in place. If this is the case, a screwdriver can be used to complete the bending of these ends.

Figure 6:
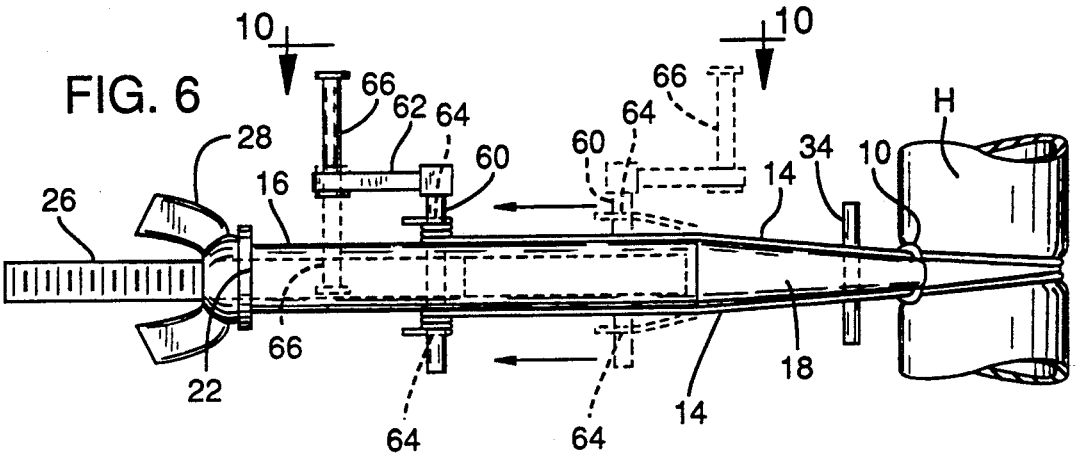
FIG. 6 is a top plan view of an embodiment of the invention that includes wire slack take-up means.
Figure 7:
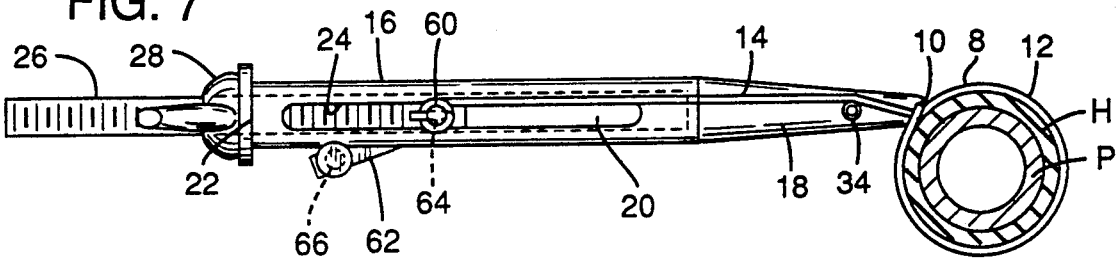
FIG. 7 is a side elevational view of the tool of FIG. 8.
Figure 8:
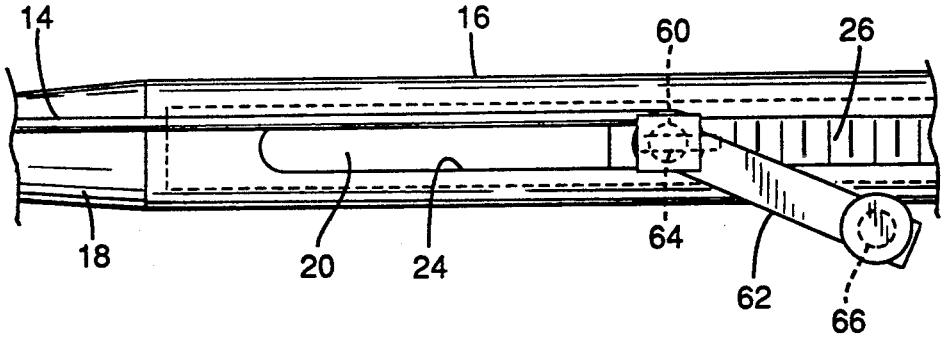
FIG. 8 is an enlarged fragmentary elevational view taken on the line 8—8 of FIG. 9.

With reference to FIGS. 6–8, an embodiment is illustrated that employs wire slack take-up means on the tension member. This embodiment employs similar structure to the FIG. 1 embodiment as concerning the tubular body portion 16, forward end portion 18 with nose end 19, side slots 24 to the interior 20 of the body portion, a threaded tension member 26 and wing nut 28 abutting against end 22 of the body portion. However the anchor means for the wire on the tension member 26 comprises a cross pin 60 that is rotatably journaled in the tension member 26 in the form of a shaft and that employs a crank 62 on one end for rotatably operating it. The pin has a diametral bore 64 on each side of the body portion through which the respective wire ends are passed and suitably connected for a winch type drive. Bores 64 are spaced outward from the body portion 16 so that the wire will wrap inward toward the body portion and thus will not subject the pin to damaging bending forces.

The crank 62 has a laterally extending handle 66 supported slidably on it adjacent its free end. This handle when extended outwardly serves as a hand grip for turning the pin 60. This rod is of sufficient length such that when slid inward, an inner end portion thereof will overlap the body portion and prevent rotation of the crank handle. Thus, in the use of the present embodiment, the handle is pulled outwardly to the full line position of FIG. 8 for rotating the pin 60, the ends of the wire first having been passed through the respective bores 64 and suitably connected for winding. After the tension member 26 has been set to a forward position, the crank is operated to take the slack out of the wire. At the completion of this slack take-up step, the handle 66 is pushed to its inner position as shown in broken lines in FIG. 6, at a suitable cranked position of the crank 62 so that the handle will prevent reverse rotation of the crank by its abutment with the body portion. Thereupon, the tension member 26 is driven back by rotation of the thumb screw 28, thus drawing the wire clamp tightly around the hose.

The slack take-up mechanism serves to pre-tighten the wire and thus speeds up operation of the tool. In addition, a minimum length of wire ends is required for attachment to the pin 60.

With reference to FIGS. 9 and 10, an embodiment of the invention is illustrated that is designed to make a wire clamp from a single strand of wire 8. This embodiment, similar to other embodiments, is a tubular body portion 16, side slots 24 to the interior 20 of the body portion, a threaded tension member 26 freely movable within the tubular body portion 16, and a wing nut 28 threadedly mounted on the tension member and abutting against the open rearward end 22 of the body member.

Tension member 26 has an integral cross pin 30 mounted intermediate the front and rearward ends thereof and projecting through the slots 24 beyond the sides of the body portion. These projecting ends form anchor means for the wire.

The forward end 70 of the tool comprises a tapered integral extension of the body portion 16 and has a cross pin 72 secured a short distance rearwardly from the tip thereof. Cross pin 72 is tubular in construction having open ends 74. The internal diameter of the pin 72 is such that one end of wire 8 can be inserted therein in the process of forming a wire clamp, now to be described.

Such process comprises first inserting an end of the wire 8 in one end of the cross pin 72 and then bringing the wire over the tip of the forward end 70 and under the opposite portion of cross pin 72, thus forming a loop 8*a* at this end of the wire. With the tool lying on the hose, the wire is then wrapped one or more times around the hose and then anchored suitably to one or both ends of the cross pin 30 on the tension member 26, the tension member first being released by the nut 28 to an inner position. After suitably anchoring the wire to the pin 30, the nut 28 is operated to draw back the tension member and tighten the wire strand on the hose. After suitable tightening to a position as shown in FIG. 10, the tool can be rotated in a plane horizontal to the hose to put a holding twist in the wire.

FIGS. 11 and 12 show an identical tool to that shown in FIGS. 9 and 10. The operation for making a clamp is identical except that in forming a clamp, the wire 8 has a preformed loop 8*b* in the one end which hooks over the tip of the forward end 70 to provide an anchor point for this wire end. The formation of the wire clamp otherwise is identical to that described in connection with FIGS. 9 and 10.

According to the invention, a clamp tool is provided that is simplified in structure and operation and operates efficiently to form the wire type clamp described. In all embodiments, the tool efficiently provides a sufficient distortion of the article so that positive seal of the article on its support member is accomplished.

Although the invention is illustrated herein as a hose clamp, it is to be understood that it can serve any clamping function wherein a flexible wire is to be cinched around a support.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A tool for cinching at least one strand of bendable wire around an article to form a clamp, said strand of wire having a connecting loop in one end thereof and a free end arranged to be wrapped around the article in clamping relation, said tool comprising:

a tubular body member having an open rearward end and a nose portion with a forward end arranged to be engaged by the loop end of the wire for holding the loop end in position on the tool, a longitudinal externally threaded tension member movable freely within said tubular body member and projecting out of said open rearward end of said body member, anchor pin means integral with said tension member providing an anchor for the wire that leads from the loop and that extends around the article to be clamped, that extends around the article to be clamped, oppositely extending lateral guide pins on said nose portion disposed rearwardly of the forward end of said nose portion for guiding the wire into a clamping relationship on an article to be clamped, and a nut member threadedly mounted on the projecting portion of said tension member in abutting relation with the rearward end of said tubular body member, said nut member in being threadedly moved in a direction toward the nose portion of said body member drawing said tension member rearwardly to tighten the wire anchored to said anchor pin means and to tighten the wire around the article.

2. The tool of claim 1 wherein said body member has longitudinally extending slot means in a side portion thereof and said anchor pin means project laterally through said slot means.

3. The tool of claim 1 including at least one lateral guide pin on said nose portion disposed rearwardly of the forward end of said nose portion for hooking a wire strand on said nose portion.

4. The tool of claim 1 wherein at least one of said lateral guide pins includes means for attaching one end of a wire to assist in forming said loop in the wire.

5. The tool of claim 1 wherein said nose end portion of said body member is pivotally attached to said body member on a pivot axis extending laterally of said nose end portion adjacent a rearward end thereof.

6. A tool for cinching a double strand of bendable wire around an article to form a clamp, said double strand of wire having a connecting loop with free ends of the strand disposed around the article and passing through the loop, said tool comprising:

a tubular body member having an open rearward end and a tapered nose end portion having a forward end arranged to engage the loop end of the wire for holding the loop end in position on the article, a longitudinally externally threaded tension member movable freely within said tubular body member and projecting out of said open rearward end of said body member, longitudinally extending opposite slots in said body member, oppositely extending anchor pin means integral with said tension member projecting laterally through respective ones of said slots and providing an anchor for the free ends of the wire that extend through the loop thereof, oppositely extending lateral guide pins on said nose end portion disposed rearwardly of the forward end of said nose end portion for guiding said free ends of the wire up toward said loop when said free ends are tightened, and a nut member threadedly mounted on the projecting portion of said tension member in abutting relation with the rearward end of said tubular body member, said nut member in being threadedly moved in a direction toward the nose end portion of said body member drawing said tension member rearwardly to tighten the free ends of the wire anchored to said oppositely extending pins and to tighten the wire around the article.

7. The tool of claim 5 wherein said nose end portion of said body member is pivotally attached to said body member on a pivot axis extending laterally of said nose end portion adjacent a rearward end thereof.

8. The tool of claim 6 including slack take-up means on said tension member arranged to take out the slack in the free ends of the wire prior to drawing said tension member rearwardly by threaded movement of said nut member.

9. The tool of claim 8 wherein said slack take-up means comprises a journaled support of said anchor pin means in said tension member, and crank means on said anchor pin means for rotating the latter to wind the free ends of the wire thereon.

10. The tool of claim 8 wherein said slack take-up means comprises a journaled support of said anchor pin means in said tension member, and crank means on said anchor pin means for rotating the latter to wind the free ends of the wire thereon, said crank means comprising a laterally extending handle slidably mounted thereon between an extended position for cranking and a retracted position overlapping said body portion to prevent unwinding of said anchor pin means.

11. A tool for cinching a double strand of bendable wire around an article to form a clamp, said double strand of wire having a connecting loop with free ends of the strand disposed around the article and passing through the loop, said tool comprising:

a tubular body member having an open rearward end and a tapered nose end portion having a forward end arranged to engage the loop end of the wire for holding the loop end in position on the article, a longitudinal externally threaded tension member movable freely within said tubular body member and projecting out of said open rearward end of said body member, longitudinally extending opposite slots in said body member, oppositely extending anchor pin means integral with said tension member projecting laterally through respective ones of said slots and providing an anchor for the free ends of the wire that extend through the loop thereof, a nut member threadedly mounted on the projecting portion of said tension member in abutting relation with the rearward end of said tubular body member, said nut member in being threadedly moved in a direction toward the nose end portion of said body member drawing said tension member rearwardly to tighten the free ends of the wire anchored to said oppositely extending pins and to tighten the wire around the article, and slack take-up means on said tension member arranged to take out the slack in the free ends of the wire prior to drawing said tension member rearwardly by threaded movement of said nut member.

12. The tool of claim 11 wherein said slack take-up means comprises a journaled support of said anchor pin means in said tension member, and crank means on said anchor pin means for rotating the latter to wind the free ends of the wire thereon.

13. The tool of claim 11 wherein said slack take-up means comprises a journaled support of said anchor pin means in said tension member, and crank means on said anchor pin means for rotating the latter to wind the free ends of the wire thereon, said crank means comprising a laterally extending handle slidably mounted thereon between an extended position for cranking and a retracted position overlapping said body portion to prevent unwinding of said anchor pin means.

* * * * *